US008591142B2

(12) United States Patent
Mittleman

(10) Patent No.: US 8,591,142 B2
(45) Date of Patent: Nov. 26, 2013

(54) APPARATUS FOR SHAPING PAVEMENT

(75) Inventor: Gary Mittleman, Loudonville, NY (US)

(73) Assignee: Advant-Edge Paving Equipment, Loudonville, NY (US)

( * ) Notice: Subject to any disclaimer, the term of this patent is extended or adjusted under 35 U.S.C. 154(b) by 36 days.

(21) Appl. No.: 13/335,801

(22) Filed: Dec. 22, 2011

(65) Prior Publication Data

US 2012/0183350 A1 Jul. 19, 2012

Related U.S. Application Data

(60) Provisional application No. 61/432,460, filed on Jan. 13, 2011.

(51) Int. Cl.
*E01C 11/22* (2006.01)

(52) U.S. Cl.
USPC ..... 404/98; 404/96

(58) Field of Classification Search
USPC ..... 404/96, 98, 104
See application file for complete search history.

(56) References Cited

U.S. PATENT DOCUMENTS

| | | | | | |
|---|---|---|---|---|---|
| 2,032,736 | A * | 3/1936 | Briggs | 405/268 |
| 3,109,351 | A * | 11/1963 | Dunn | 404/104 |
| 3,445,944 | A * | 5/1969 | Speno | 37/105 |
| 3,680,451 | A * | 8/1972 | Birtchet | 404/104 |
| 3,915,583 | A * | 10/1975 | Aparicio | 404/98 |
| 3,936,211 | A * | 2/1976 | Miller et al. | 404/104 |
| 4,068,969 | A * | 1/1978 | Beach et al. | 404/98 |
| 4,181,449 | A | 1/1980 | Lenker | |
| 5,344,254 | A * | 9/1994 | Sartain | 404/104 |
| 6,238,134 | B1 | 5/2001 | Sovik | |
| 6,238,136 | B1 | 5/2001 | Sovik et al. | |
| 6,270,284 | B1 | 8/2001 | Sovik | |
| 6,273,636 | B1 * | 8/2001 | Johanpeter | 404/104 |
| 6,283,672 | B1 | 9/2001 | Sovik | |
| 6,923,594 | B2 | 8/2005 | Sovik et al. | |
| 6,988,850 | B2 | 1/2006 | Sovik et al. | |
| 7,121,763 | B1 * | 10/2006 | Young et al. | 404/118 |
| 7,909,534 | B1 * | 3/2011 | Comer et al. | 404/118 |

* cited by examiner

*Primary Examiner* — Matthew D Troutman

(57) ABSTRACT

An apparatus for shaping pavement, the apparatus comprising a pavement-shaping member for receiving a flow of shapeless pavement material and generating a flow of shaped pavement material and a paving machine mount, mechanically coupled to the pavement-shaping member, for coupling the pavement-shaping member to a paving machine, the pavement-shaping member comprising a detachable forming shoe for producing the shaped pavement material.

55 Claims, 5 Drawing Sheets

APPARATUS FOR SHAPING PAVEMENT

CROSS-REFERENCE TO RELATED APPLICATIONS

This application claims the benefit of provisional application number 61/432,460, filed Jan. 13, 2011.

BACKGROUND

The present invention relates generally to the field of roadway paving equipment and more specifically to the field of pavement-shaping devices.

As used herein: "pavement" refers to any material—including, without limitation, asphalt concrete, Portland cement concrete, HMA, soil, or gravel—laid down over a pre-existing roadway; "roadway" refers to any surface on which a paving machine (paver) may be driven including, without limitation, streets, roads, highways, driveways, bicycle paths, jogging paths, runways, and unpaved road beds; "paving" refers to the process of laying down pavement.

In a wide variety of applications, pavement-shaping devices are used to produce a desired shape at the edge of a paved roadway. Often, the desired shape provides a ramp to allow vehicles to more easily and more safely regain the roadway after inadvertently driving off the edge.

Typically, conventional pavement-shaping devices suffer from several disadvantages: wearing of surfaces in contact with the pavement often necessitates expensive replacement of the entire device; and movement of the device to accommodate irregularities in the roadway is often impeded by pavement inadvertently flowing between the device and the paver or by binding of various device moving parts.

Opportunities exist, therefore, to provide an improved pavement-shaping device having, individually or in combination, a detachable forming shoe in contact with the pavement, a flap for preventing pavement from inadvertently flowing between the device and the paver, and an improved restoring assembly for accommodating roadway irregularities without binding.

SUMMARY

The opportunities described above are addressed in one aspect of the present invention wherein an apparatus for shaping pavement comprises: a pavement-shaping member for receiving a flow of shapeless pavement material and generating a flow of shaped pavement material; and a paving machine mount, mechanically coupled to the pavement-shaping member, for coupling the pavement-shaping member to a paving machine, the pavement-shaping member comprising: a detachable forming shoe for producing the shaped pavement material.

In another aspect of the present invention, an apparatus for shaping pavement comprises: a pavement-shaping member for receiving a flow of shapeless pavement material and generating a flow of shaped pavement material; and a paving machine mount, mechanically coupled to the pavement-shaping member, for coupling the pavement-shaping member to a paving machine, the pavement-shaping member comprising: a forming wedge for shaping the shapeless pavement; a wedge support assembly, rotatably coupled to the forming wedge and operably coupled to the paving machine mount, for supporting the forming wedge; a flap, slidably coupled to the wedge support assembly, slidably coupled to the forming wedge, and disposed and configured for restricting a flow of pavement between the apparatus for shaping pavement and the paving machine; and a flap spring, mechanically coupled to the flap and the wedge support assembly, and configured for maintaining contact between the flap and the forming wedge.

In another aspect of the present invention, an apparatus for shaping pavement comprises: a pavement-shaping member for receiving a flow of shapeless pavement material and generating a flow of shaped pavement material; and a paving machine mount, mechanically coupled to the pavement-shaping member, for coupling the pavement-shaping member to a paving machine, the pavement-shaping member comprising: a forming wedge for adjusting the shape of the pavement-shaping member; a wedge support assembly, rotatably coupled to the forming wedge and adjustably coupled to the paving machine mount, for supporting the forming wedge and adjusting the position of the pavement-shaping member; and a restoring assembly disposed for transmitting a restoring bias from the wedge support assembly to the forming wedge, the restoring assembly being operably coupled to the forming wedge and mechanically coupled to the wedge support assembly, the restoring assembly comprising: a compression spring mechanically coupled to the wedge support assembly, operably coupled to the forming wedge, and disposed and configured for providing the restoring bias; a piston slide component mechanically coupled to the forming wedge; and a piston operably coupled to the compression spring and slidably coupled to the piston slide component.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
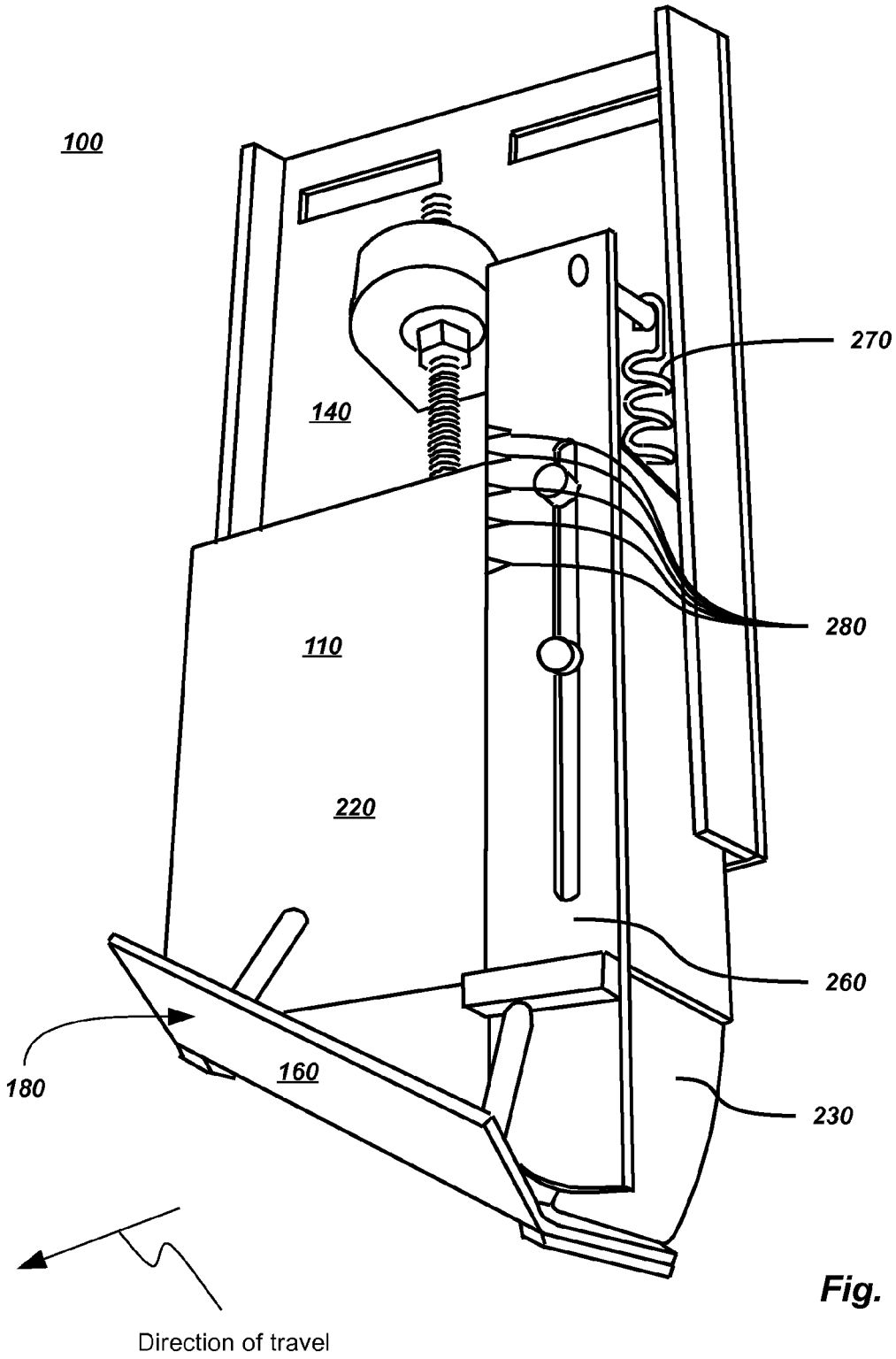
FIG. 1 illustrates a perspective drawing in accordance with one embodiment of the present invention.
Figure 2:
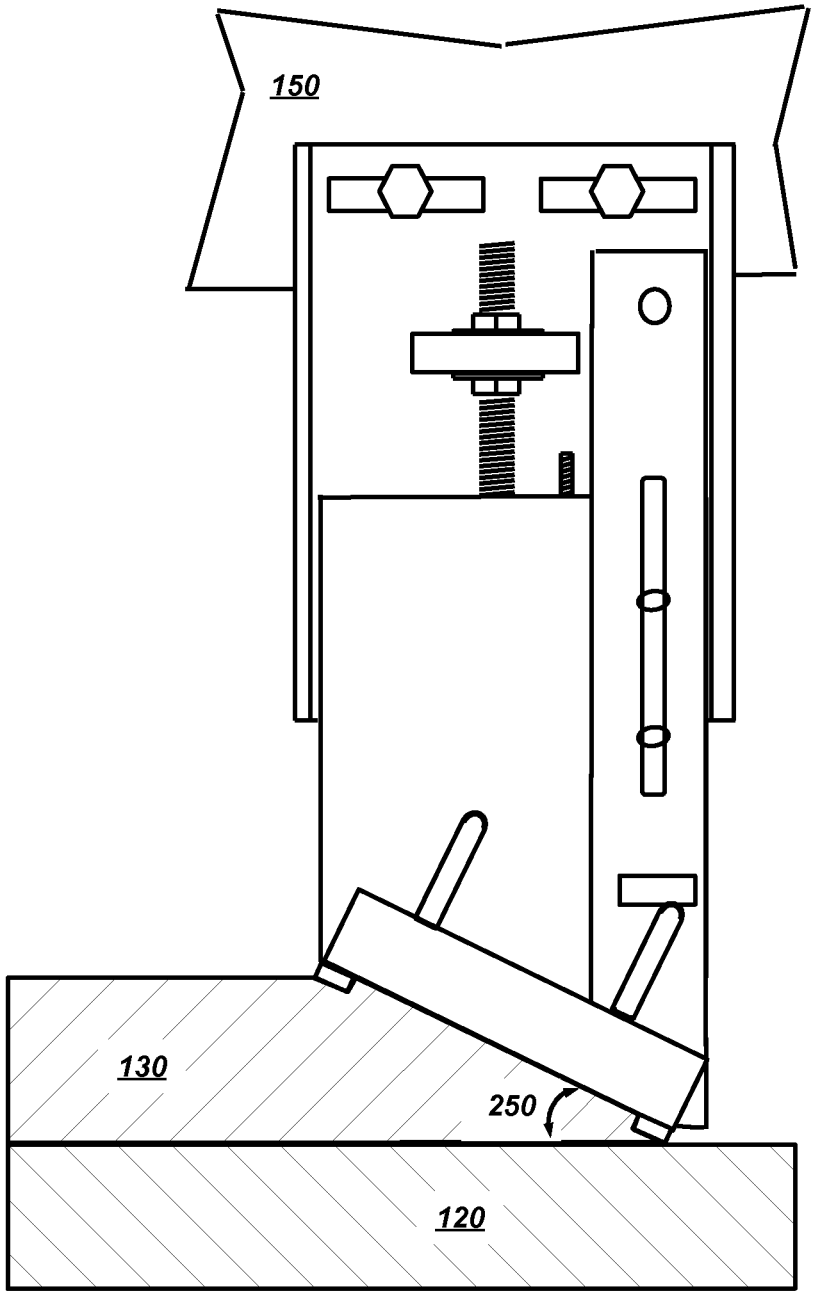
FIG. 2 illustrates a front view orthographic drawing in accordance with the embodiment of FIG. 1.

In accordance with an embodiment of the present invention, FIG. 1 is a perspective drawing illustrating an apparatus for shaping pavement 100. FIG. 2 is an orthographic drawing illustrating apparatus 100. Apparatus 100 comprises a pavement-shaping member 110 and a paving machine mount 140, mechanically coupled to a paving machine 150. In operation, pavement-shaping member 110 receives a flow of shapeless pavement material and generates a flow of shaped pavement material 130. Pavement-shaping member 110 comprises a detachable forming shoe 160 for shaping shapeless pavement material into shaped pavement material 130.

Paving machine 150 refers to any device or assembly capable of paving pavement material. Shapeless pavement material refers to pavement material prior to any paving activities or shaping. Shaped pavement material 130 refers to shapeless pavement material after paving or shaping.

Pavement shaping member 110 refers to a mechanical component of any kind capable of shaping pavement. In typical embodiments, pavement shaping member 110 is made of any material compatible with shapeless pavement material, including, by way of example, not limitation, heat-treated steel, 300-degree Fahrenheit heat-resistant material, high temperature plastics, composites, graphites, fiberglass, and abrasive resistant steel. Detachable forming shoe 160 refers to any mechanical component, assembly, or combination thereof, used to shape shapeless pavement material.

Paving machine mount 140 refers to a mechanical component of any kind capable of mechanically coupling apparatus 100 to any part of paving machine 150. In a typical embodiment, paving machine mount 140 couples to a screed of paving machine 150. As used herein, the endgate and screed extension of paving machine 150 are considered part of the screed.

Figure 3:
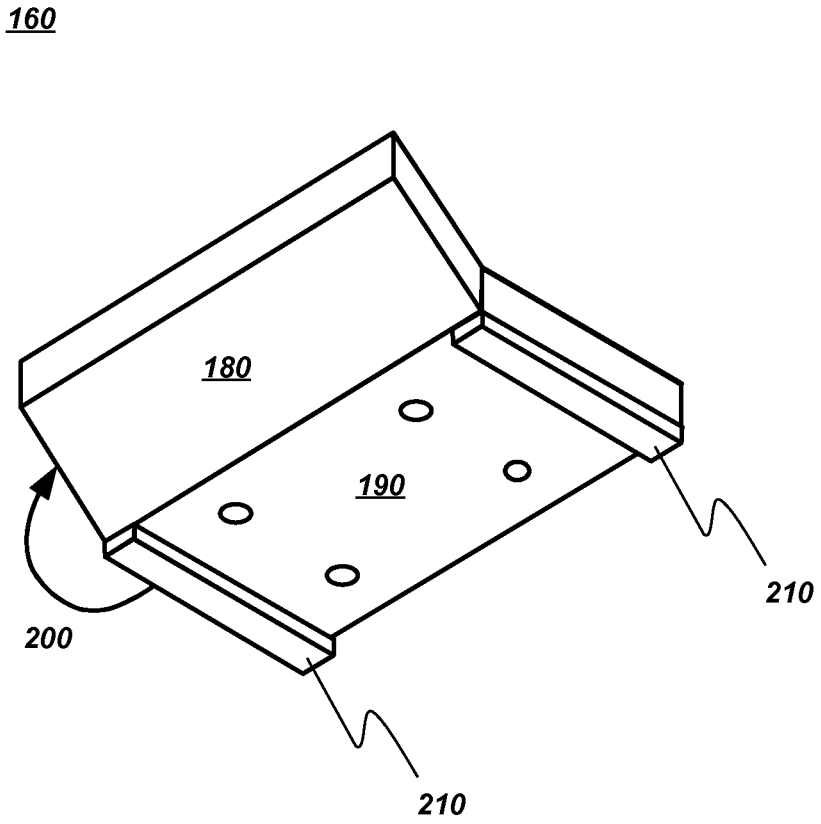
FIG. 3 illustrates a perspective drawing in accordance with another more detailed embodiment of the embodiment of FIG. 1.

According to a more detailed embodiment of the present invention, as illustrated in FIG. 3, detachable forming shoe 160 is symmetric side to side, so that the same detachable forming shoe 160 can be used when pavement shaping member 110 is mounted on either the left or right side of paving machine 150.

In a more detailed embodiment in accordance with the embodiment of FIG. 1, FIG. 3 illustrates detachable forming shoe 160 comprising a funneling surface 180 for funneling shapeless pavement material and a troweling surface 190 mechanically coupled to funneling surface 180 at a funneling angle 200 and configured for troweling shapeless pavement material. In some embodiments, funneling angle 200 is between about 181 degrees and about 225 degrees. Typically, funneling angle 200 is about 203 degrees. In operation, as paving machine 150 moves forward, funneling surface 180 funnels shapeless pavement material toward troweling surface 190.

In some embodiments, troweling surface 190 further comprises an abrasive resistant surface 210 mechanically coupled to troweling surface 190. Abrasive resistant surface 210 is made of an abrasion resistant material capable of resisting abrasion caused by pavement material. Examples of abrasion resistant materials include, without limitation, diamond, silicon carbide, abrasion resistant steel, and sapphire.

Figure 4:
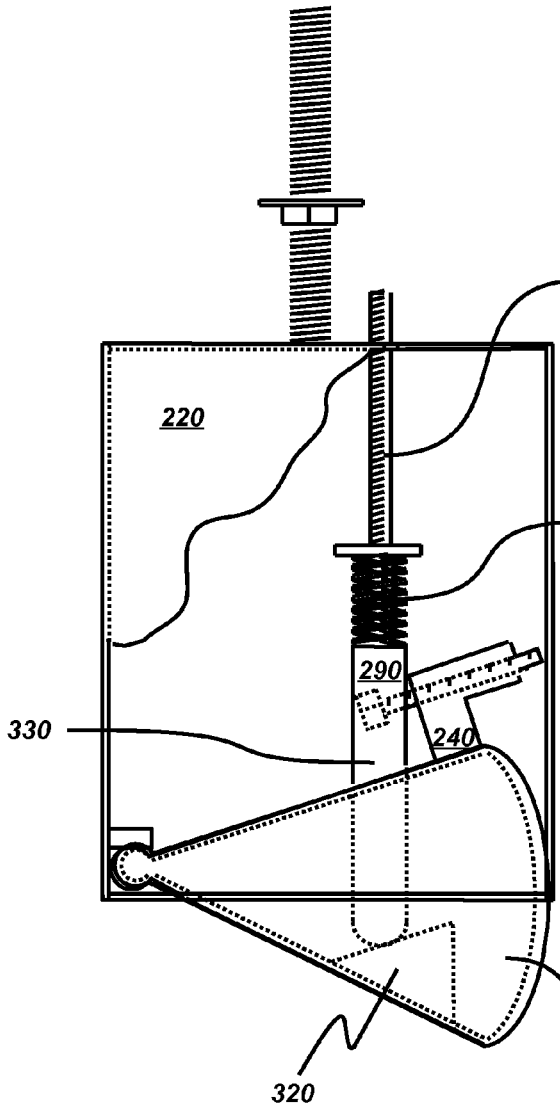
FIG. 4 illustrates a cut-away front view orthographic drawing in accordance with yet another more detailed embodiment of the embodiment of FIG. 1.
Figure 5:
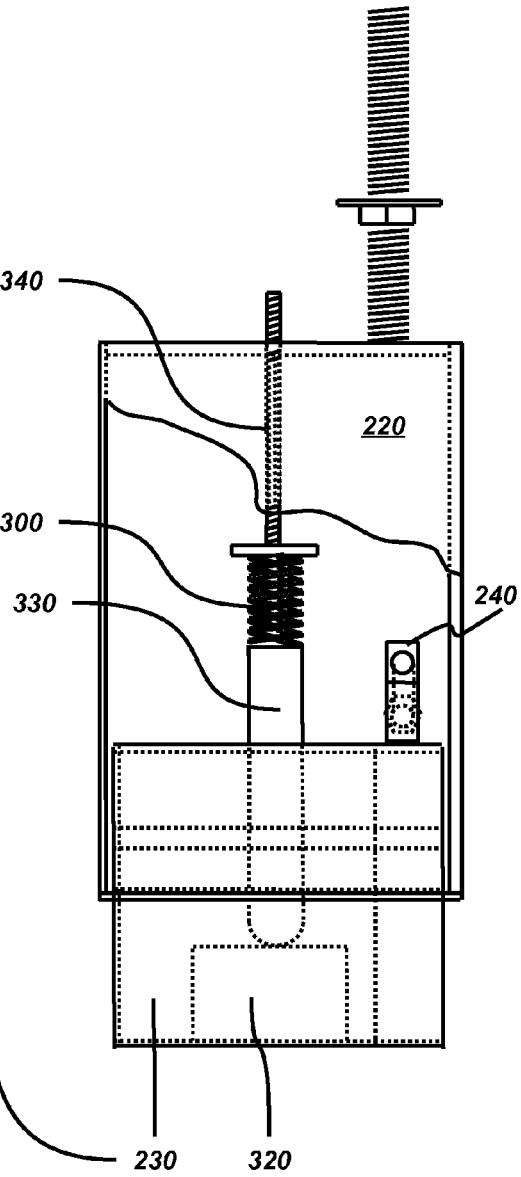
FIG. 5 illustrates a cut-away side view orthographic drawing in accordance with the embodiment of FIG. 4.

FIG. 4 and FIG. 5 illustrate a more detailed embodiment of apparatus 100 wherein pavement shaping member 110 further comprises a forming wedge 230 and a wedge support assembly 220, rotatably coupled to forming wedge 230 and adjustably coupled to paving machine mount 140. Forming wedge 230 refers to any mechanical component, assembly, or combination thereof, capable of adjusting the shape of pavement shaping member 110. Wedge support assembly 220 refers to any mechanical component utilized to support forming wedge 230 and for adjusting the position of pavement-shaping member 110; detachable forming shoe 160 is detachably coupled to forming wedge 230.

In operation, the height of wedge support assembly 220 is adjusted until detachable forming shoe 160 is at the correct height to produce shaped pavement material 130. Forming wedge 230 is also configured to produce the desired shape of shaped pavement material 130.

In a more detailed embodiment of apparatus 100 as illustrated in FIG. 4, pavement shaping member 110 further comprises a rotational stop adjustment assembly 240 mechanically coupled to forming wedge 230. Rotational stop adjustment assembly 240 refers to any mechanical assembly capable of adjusting a maximum wedge angle. Examples of rotational stop adjustment assembly 240 include, but are not limited to, threaded rod assemblies, pin assemblies, and bolt assemblies.

In another more detail embodiment in accordance with the embodiment of FIG. 1, pavement shaping member 110 further comprises a flap 260, slidably coupled to wedge support assembly 220 and slidably coupled to forming wedge 230; and a flap spring 270, mechanically coupled to flap 260 and wedge support assembly 220. Flap 260 refers to any mechanical component capable of restricting the flow of pavement between apparatus 100 and paving machine 150. Flap spring 270 refers to any mechanical component capable of maintaining contact between flap 260 and forming wedge 230. Examples of flap spring 270 include, without limitation, compression springs and die springs.

In some embodiments, flap 260 further comprises flap marking 280 configured for measuring a pavement ramp angle 250 (FIG. 2). Pavement ramp angle 250 is defined as the angle between a plane tangent to the surface of shaped pavement material 130 and a plane tangent to the surface of pre-existing roadway 120. Flap marking 280 refers to marking on flap 260 to indicate a measurement of pavement ramp angle 250. Flap marking 280 is produced, by way of example, not limitation, by chemical etching, painting, or milling. In a typical embodiment, flap marking 280 comprises notches in flap 260 indicating pavement ramp angle 250 in about 5-degree increments.

In accordance with yet another more detailed embodiment of the embodiment of FIG. 1, FIG. 4 illustrates a cut-away front view orthographic drawing wherein pavement shaping member 110 further comprises a restoring assembly 290 operably coupled to forming wedge 230 and mechanically coupled to wedge support assembly 220. Restoring assembly 290 refers to any mechanical component capable of generating and transmitting a restoring bias from wedge support assembly 220 to forming wedge 230. Restoring bias refers to a force or a torque applied so as to keep an edge of detachable forming shoe 160 in contact with the roadway.

In a more detailed embodiment in accordance with FIG. 4, restoring assembly 290 comprises a compression spring 300 mechanically coupled to wedge support assembly 220 and operably coupled to forming wedge 230. Compression spring 300 refers to any mechanical component capable of providing restoring bias. Examples of compression spring 300 include, without limitation, die springs, helical coils, square end coils, barrel coils, hourglass coils, straight coils, and ground end springs. Typically, compression spring 300 is a die spring.

In a more detailed embodiment in accordance with FIG. 4, restoring assembly 290 further comprises a piston slide component 320, mechanically coupled to forming wedge 230, and a piston 330, operably coupled to compression spring 300 and slidably coupled to piston slide component 320. Piston slide component 320 is any mechanical component capable of slidably coupling to piston 330. Piston 300 is any mechanical component capable of transmitting restoring bias from compression spring 300.

In a more detailed embodiment in accordance with FIG. 4, restoring assembly 290 further comprises a restoring adjustment rod 340 mechanically coupled to wedge support assembly 220. Restoring adjustment rod 340 is any mechanical component capable of adjusting the compression of compression spring 300. In some embodiments, compression spring 300 has a spring constant of between about 10 and about 300 pounds per inch. In typical embodiments, the spring constant of compression spring 300 is about 200 pounds per inch or about 75 pounds per inch.

Figure 6:
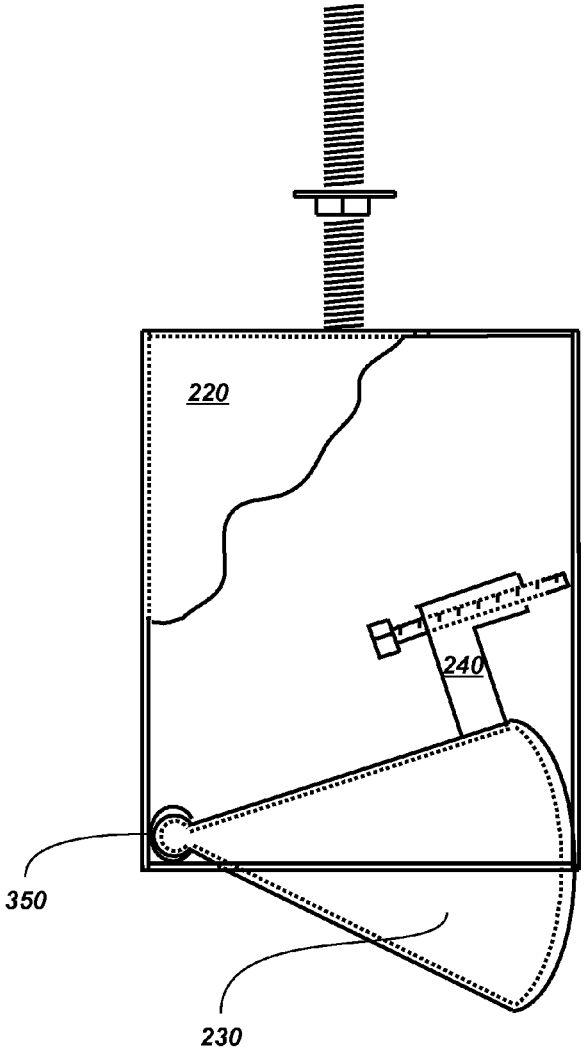
FIG. 6 illustrates a cut-away front view orthographic drawing in accordance with an alternative embodiment to the embodiment of FIG. 4.
Figure 7:
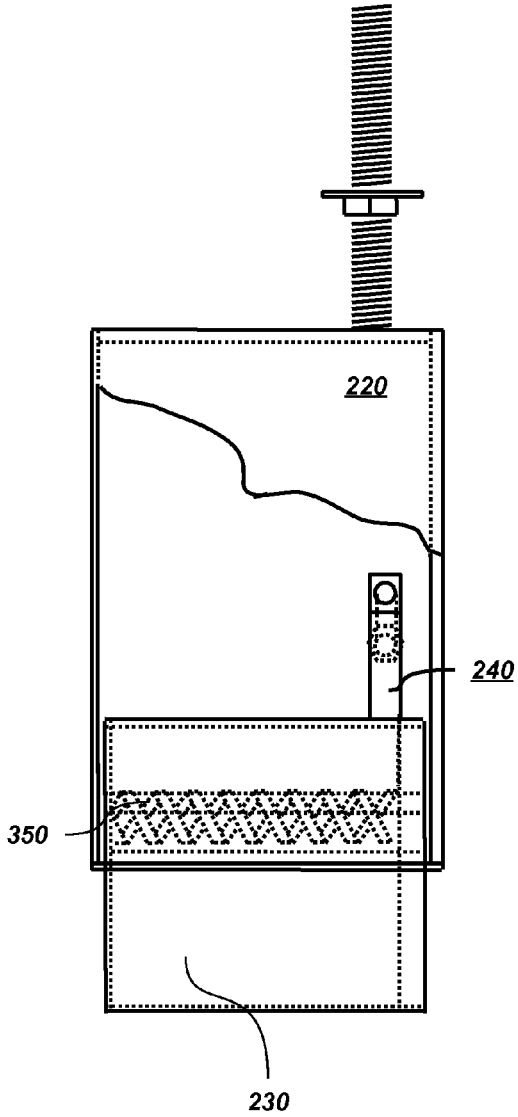
FIG. 7 illustrates a cut-away side view orthographic drawing in accordance the embodiment of FIG. 6.

According to an alternative embodiment illustrated in FIG. 6, restoring assembly 290 comprises a torsion spring 350, mechanically coupled to wedge support assembly 220 and operably coupled to forming wedge 230. Torsion spring 350 refers to any mechanical component capable of providing restoring bias as torque. In some embodiments torsion spring 350 has a spring constant between about 9 inch-pounds per degree and about 300 inch-pounds per degree. In a typical embodiment, torsion spring 350 has a spring constant of about 196 inch-pounds per degree.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An apparatus for shaping pavement, said apparatus comprising:

a pavement-shaping member for receiving a flow of shapeless pavement material and generating a flow of shaped pavement material; and a paving machine mount, mechanically coupled to said pavement-shaping member, for coupling said pavement-shaping member to a paving machine, said pavement-shaping member comprising:

a detachable forming shoe for producing said shaped pavement material, wherein said detachable forming shoe comprises:

a funneling surface for funneling said shapeless pavement material; and a troweling surface mechanically coupled to said funneling surface at a funneling angle and configured for troweling said shapeless pavement material, wherein said pavement-shaping member further comprises:

a forming wedge for adjusting the shape of said pavement-shaping member; and a wedge support assembly, rotatably coupled to said forming wedge and adjustably coupled to said paving machine mount, for supporting said forming wedge and adjusting the position of said pavement-shaping member, said detachable forming shoe being detachably coupled to said forming wedge.

2. The apparatus of claim 1 wherein said detachable forming shoe is symmetric side to side.

3. The apparatus of claim 1 wherein said paving machine mount is mechanically coupled to a screed of said paving machine.

4. The apparatus of claim 1 wherein said funneling angle is between about 181 degrees and about 225 degrees.

5. The apparatus of claim 1 wherein said funneling angle is about 203 degrees.

6. The apparatus of claim 1 wherein said troweling surface further comprises:

an abrasive resistant surface, disposed parallel to and mechanically coupled to said troweling surface.

7. The apparatus of claim 1 wherein said pavement-shaping member further comprises a rotational stop adjustment assembly configured for adjusting a maximum wedge angle and mechanically coupled to said forming wedge.

8. The apparatus of claim 1 wherein said pavement-shaping member further comprises:

a flap, slidably coupled to said wedge support assembly, slidably coupled to said forming wedge, and disposed and configured for restricting a flow of pavement between said apparatus for shaping pavement and said paving machine; and a flap spring, mechanically coupled to said flap and said wedge support assembly, and configured for maintaining contact between said flap and said forming wedge.

9. The apparatus of claim 8 wherein said flap further comprises flap marking configured for measuring a pavement ramp angle.

10. The apparatus of claim 9 wherein said flap marking indicates a 5 degree increment in said pavement ramp angle.

11. The apparatus of claim 1 wherein said pavement-shaping member further comprises:

a restoring assembly disposed for transmitting a restoring bias from said wedge support assembly to said forming wedge, said restoring assembly being operably coupled to said forming wedge and mechanically coupled to said wedge support assembly.

12. The apparatus of claim 11 wherein said restoring assembly comprises:

a compression spring mechanically coupled to said wedge support assembly, operably coupled to said forming wedge, and disposed and configured for providing said restoring bias.

13. The apparatus of claim 12 wherein said restoring assembly further comprises:

a piston slide component mechanically coupled to said forming wedge; and a piston operably coupled to said compression spring and slidably coupled to said piston slide component.

14. The apparatus of claim 12 wherein said restoring assembly further comprises:

a restoring adjustment rod mechanically coupled to said wedge support assembly and said compression spring, said restoring adjustment rod being positionally adjustable for adjusting the compression of said compression spring.

15. The apparatus of claim 12 wherein said compression spring has a spring constant between about 10 and about 300 pounds per inch.

16. The apparatus of claim 15 wherein said compression spring has a spring constant of about 200 pounds per inch.

17. The apparatus of claim 15 wherein said compression spring has a spring constant of about 75 pounds per inch.

18. The apparatus of claim 11 wherein said restoring assembly comprises:

a torsion spring, mechanically coupled to said wedge support assembly, operably coupled to said forming wedge, and disposed and configured for providing said restoring bias.

19. The apparatus of claim 18 wherein said torsion spring has a spring constant between about 9 and about 300 inch-pounds per degree.

20. The apparatus of claim 19 wherein said torsion spring has a spring constant of about 196 inch-pounds per degree.

21. An apparatus for shaping pavement, said apparatus comprising:

a pavement-shaping member for receiving a flow of shapeless pavement material and generating a flow of shaped pavement material; and a paving machine mount, mechanically coupled to said pavement-shaping member, for coupling said pavement-shaping member to a paving machine, said pavement-shaping member comprising:

a forming wedge for shaping said shapeless pavement;

a wedge support assembly, rotatably coupled to said forming wedge and operably coupled to said paving machine mount, for supporting said forming wedge;

a flap, slidably coupled to said wedge support assembly, slidably coupled to said forming wedge, and disposed and configured for restricting a flow of pavement between said apparatus for shaping pavement and said paving machine; and a flap spring, mechanically coupled to said flap and said wedge support assembly, and configured for maintaining contact between said flap and said forming wedge.

22. The apparatus of claim 21, wherein said wedge support assembly is adjustably coupled to said paving machine mount, for adjusting the position of said pavement-shaping member.

23. The apparatus of claim 21 wherein said paving machine mount is mechanically coupled to a screed of said paving machine.

24. The apparatus of claim 21 wherein said pavement-shaping member further comprises a rotational stop adjustment assembly configured for adjusting a maximum wedge angle and mechanically coupled to said forming wedge.

25. The apparatus of claim 21 wherein said flap further comprises flap marking configured for measuring a pavement ramp angle.

26. The apparatus of claim 25 wherein said flap marking indicates a 5 degree increment in said pavement ramp angle.

27. The apparatus of claim 21 wherein said pavement-shaping member further comprises:

a restoring assembly disposed for transmitting a restoring bias from said wedge support assembly to said forming wedge, said restoring assembly being operably coupled to said forming wedge and mechanically coupled to said wedge support assembly.

28. The apparatus of claim 27 wherein said restoring assembly comprises:

a compression spring mechanically coupled to said wedge support assembly, operably coupled to said forming wedge, and disposed and configured for providing said restoring bias.

29. The apparatus of claim 28 wherein said restoring assembly further comprises:

a piston slide component mechanically coupled to said forming wedge; and a piston operably coupled to said compression spring and slidably coupled to said piston slide component.

30. The apparatus of claim 28 wherein said restoring assembly further comprises:

a restoring adjustment rod mechanically coupled to said wedge support assembly and said compression spring, said restoring adjustment rod being positionally adjustable for adjusting the compression of said compression spring.

31. The apparatus of claim 28 wherein said compression spring has a spring constant between about 10 and about 300 pounds per inch.

32. The apparatus of claim 31 wherein said compression spring has a spring constant of about 200 pounds per inch.

33. The apparatus of claim 31 wherein said compression spring has a spring constant of about 75 pounds per inch.

34. The apparatus of claim 27 wherein said restoring assembly comprises:

a torsion spring, mechanically coupled to said wedge support assembly, operably coupled to said forming wedge, and disposed and configured for providing said restoring bias.

35. The apparatus of claim 34 wherein said torsion spring has a spring constant between about 9 and about 300 inch-pounds per degree.

36. The apparatus of claim 35 wherein said torsion spring has a spring constant of about 196 inch-pounds per degree.

37. An apparatus for shaping pavement, said apparatus comprising:

a pavement-shaping member for receiving a flow of shapeless pavement material and generating a flow of shaped pavement material; and a paving machine mount, mechanically coupled to said pavement-shaping member, for coupling said pavement-shaping member to a paving machine, said pavement-shaping member comprising:

a forming wedge for adjusting the shape of said pavement-shaping member;

a wedge support assembly, rotatably coupled to said forming wedge and adjustably coupled to said paving machine mount, for supporting said forming wedge and adjusting the position of said pavement-shaping member; and a restoring assembly disposed for transmitting a restoring bias from said wedge support assembly to said forming wedge, said restoring assembly being operably coupled to said forming wedge and mechanically coupled to said wedge support assembly, said restoring assembly comprising:

a compression spring mechanically coupled to said wedge support assembly, operably coupled to said forming wedge, and disposed and configured for providing said restoring bias;

a piston slide component mechanically coupled to said forming wedge; and a piston operably coupled to said compression spring and slidably coupled to said piston slide component.

38. The apparatus of claim 37 wherein said paving machine mount is mechanically coupled to a screed of said paving machine.

39. The apparatus of claim 37 wherein said pavement-shaping member further comprises a rotational stop adjustment assembly configured for adjusting a maximum wedge angle and mechanically coupled to said forming wedge.

40. The apparatus of claim 37 wherein said pavement-shaping member further comprises:

a flap, slidably coupled to said wedge support assembly, slidably coupled to said forming wedge, and disposed and configured for restricting a flow of pavement between said apparatus for shaping pavement and said paving machine; and a flap spring, mechanically coupled to said flap and said wedge support assembly, and configured for maintaining contact between said flap and said forming wedge.

41. The apparatus of claim 40 wherein said flap further comprises flap marking configured for measuring a pavement ramp angle.

42. The apparatus of claim 41 wherein said flap marking indicates a 5 degree increment in said pavement ramp angle.

43. The apparatus of claim 37 wherein said restoring assembly further comprises:

a restoring adjustment rod mechanically coupled to said wedge support assembly and said compression spring, said restoring adjustment rod being positionally adjustable for adjusting the compression of said compression spring.

44. The apparatus of claim 37 wherein said compression spring has a spring constant between about 10 and about 300 pounds per inch.

45. The apparatus of claim 44 wherein said compression spring has a spring constant of about 200 pounds per inch.

46. The apparatus of claim 44 wherein said compression spring has a spring constant of about 75 pounds per inch.

47. An apparatus for shaping pavement, said apparatus comprising:

a pavement-shaping member for receiving a flow of shapeless pavement material and generating a flow of shaped pavement material; and a paving machine mount, mechanically coupled to said pavement-shaping member, for coupling said pavement-shaping member to a paving machine, said pavement-shaping member comprising:

a forming wedge for adjusting the shape of said pavement-shaping member;

a detachable forming shoe for producing said shaped pavement material, detachable coupled to said forming wedge;

a wedge support assembly, rotatably coupled to said forming wedge and adjustably coupled to said paving machine mount, for supporting said forming wedge and adjusting the position of said pavement-shaping member; and a restoring assembly disposed for transmitting a restoring bias from said wedge support assembly to said forming wedge, said restoring assembly being operably coupled to said forming wedge and mechanically coupled to said wedge support assembly, said restoring assembly comprising:

a compression spring mechanically coupled to said wedge support assembly, operably coupled to said forming wedge, and disposed and configured for providing said restoring bias;

a piston slide component mechanically coupled to said forming wedge; and a piston operably coupled to said compression spring and slidably coupled to said piston slide component, said detachable forming shoe being symmetric front to back and comprising:

a funneling surface for funneling said shapeless pavement material; and a troweling surface mechanically coupled to said funneling surface at a funneling angle and configured for troweling said shapeless pavement material, said paving machine mount being mechanically coupled to a screed of said paving machine.

48. The apparatus of claim 47 wherein said pavement-shaping member further comprises a rotational stop adjustment assembly configured for adjusting a maximum wedge angle and mechanically coupled to said forming wedge.

49. The apparatus of claim 47 wherein said pavement-shaping member further comprises:

a flap, slidably coupled to said wedge support assembly, slidably coupled to said forming wedge, and disposed and configured for restricting a flow of pavement between said apparatus for shaping pavement and said paving machine; and a flap spring, mechanically coupled to said flap and said wedge support assembly, and configured for maintaining contact between said flap and said forming wedge.

50. The apparatus of claim 49 wherein said flap further comprises flap marking configured for measuring a pavement ramp angle.

51. The apparatus of claim 50 wherein said flap marking indicates a 5 degree increment in said pavement ramp angle.

52. The apparatus of claim 47 wherein said restoring assembly further comprises:

a restoring adjustment rod mechanically coupled to said wedge support assembly and said compression spring, said restoring adjustment rod being positionally adjustable for adjusting the compression of said compression spring.

53. The apparatus of claim 47 wherein said compression spring has a spring constant between about 10 and about 300 pounds per inch.

54. The apparatus of claim 53 wherein said compression spring has a spring constant of about 200 pounds per inch.

55. The apparatus of claim 53 wherein said compression spring has a spring constant of about 75 pounds per inch.

* * * * *